US005174846A

United States Patent [19]

Bate et al.

[11] Patent Number: 5,174,846

[45] Date of Patent: Dec. 29, 1992

[54] WRAPPING ELONGATE ARTICLES

[75] Inventors: Paul Bate, Birmingham; Roy N. Lefevre, Leek Wootton, both of England

[73] Assignee: Carrs Paper Limited, Solihull, United Kingdom

[21] Appl. No.: 494,408

[22] Filed: Mar. 16, 1990

[30] Foreign Application Priority Data

Mar. 18, 1989 [GB] United Kingdom ..... 8906277

[51] Int. Cl.[5] ..... B32B 31/00

[52] U.S. Cl. ..... 156/185; 156/187; 156/195; 156/201; 156/392

[58] Field of Search ..... 156/187, 195, 392, 185, 156/188, 201, 202; 427/208.6

[56] References Cited

U.S. PATENT DOCUMENTS 2,354,556 7/1944 Stahl ..... 156/190 X
2,539,450 1/1951 Magill ..... 156/195 X
3,286,904 11/1966 Vieth et al. .
3,607,516 9/1971 Royston ..... 156/392 X
4,409,776 10/1983 Usui .
4,440,821 4/1984 Komura et al. ..... 427/208.6 X

FOREIGN PATENT DOCUMENTS 2256708 5/1974 Fed. Rep. of Germany .

*Primary Examiner*—David A. Simmons
*Assistant Examiner*—James J. Engel, Jr.
*Attorney, Agent, or Firm*—Spensley Horn Jubas & Lubitz

[57] ABSTRACT

An elongated article is wrapped by forming thereon a winding of a strip of a flexible wrapping material (12) which has a first face (13) carrying first and second portions (13*a*, 13*b*) of a coating of an adhesive substance of a per se known kind which without the application of heat adheres strongly only to itself, the second face (15) being free from such adhesive substance, and by turning over a longitudinal edge portion of the strip which includes said first portion (13*a*) of the coating, as the strip is wound around the article, so as to bring it into face-to-face with the second portion (13*b*) of the coating on a previously formed turn of the winding.

9 Claims, 2 Drawing Sheets

WRAPPING ELONGATE ARTICLES

BACKGROUND OF THE INVENTION

This invention relates to a method of wrapping elongate articles such as pipes, rods, tubes and the like elements, which may be substantially straight through-out their length, or of curved or other non-linear form, or even in the form of a closed loop (for example a coil of wire), such elements being wrapped either singularly or in bundles, and the term "elongate article" as used herein is intended to encompass both such elements singly and bundles of such elements.

Conventionally, such articles are wrapped by means of one or more lengths of paper or the like which are wound helically around them using appropriate machinery, for example as shown in German Patent specification No. 2256708, so that adjacent windings overlap somewhat. In many cases such articles are relatively flexible, due often to their length, which may be some 6 or 7 meters for example. As a result flexing of the package gives rise to a tendency for adjacent turns of the wrapping to separate, thereby exposing the article to potential damage. To reduce this tendency it is often desirable for the adjacent windings to be adhesively secured together where they overlap. However with conventional wrapping systems this requires the application of a liquid or flowable adhesive substance, e.g. a glue, to the edge zone of the wrapping material as this is unrolled by the wrapping machine and laid onto the exterior surface of the article being wrapped.

The provision of such gluing apparatus naturally increases the cost of the machine, but there is the additional disadvantage that supplies of an appropriate adhesive are required to be maintained, and moreover the operational difficulties in maintaining the gluing apparatus to function properly under conditions of use is such that such apparatus has not met with commercial success.

The use of wrapping materials, coated with conventional adhesive materials of the kind which are tacky and adhere to most materials which are not specially treated has not generally been considered to be practicable because of the need for a release paper or the like between adjacent turns of the material in the roll on which it is supplied, and the adherance of contaminating material to any exposed area of said adhesive material on the wrapping material when in use, or the adherence of the wrapping material to the articles wrapped therein.

One proposal which attempts at least partially to overcome such drawbacks is described in U.S. Pat. No. 4,409,776. This involves using a wrapping material which has an adhesive coating on one face only and forming two layers of wrapping around the article, an inner layer in which the adhesive-coated face is presented outwardly and an outer layer in which the adhesive-coated face is presented inwardly. In this way, no adhesive material contacts the wrapped article, nor it is exposed externally. However, this method has several disadvantages. In particular, since two layers of wrapping are required, it uses twice the quantity of wrapping material which would be required by a single-layer wrapping technique. Specifically, in this proposal the second layer is formed by reversing the wrapping machine so that it is suitable only for batch operation rather than continuous wrapping. Alternatively, to adapt the method for continuous wrapping, it would be necessary to provide two wrapping machines, one for each layer, with consequent increase in capital and maintenance costs as well as extra space requirements.

The object of the invention is to provide an improved method of wrapping elongate articles which obviates or reduces the above-mentioned disadvantages.

SUMMARY OF THE INVENTION

According to the invention we provide a method of wrapping an elongate article by forming a winding of at least one strip of flexible wrapping material helically around said article so that successive turns of the wrapping overlap one another, characterised by the use of a strip of wrapping material wherein a first face of the strip carries first and second portions of a coating of an adhesive substance of a per se known kind which without the application of heat adheres strongly only to itself and wherein a second face of the strip is free from said adhesive material, and by the steps of turning over a longitudinal edge portion of said strip which includes said first portion of the coating so as to fold the second face of the strip onto itself, and laying the folded strip onto the article with the second portion of the coating on each turn of the winding in contact with the first portion of said coating on an adjacent turn of the winding.

Since the adhesive substance is formulated not to adhere to the uncoated surface of the strip of wrapping material, it can be formed into a roll without necessitating the use of release paper. It can also be handled by wrapping machinery without difficulty, and it will not adhere directly to the article being wrapped. However, as the wrapping material is fed towards the article to be wrapped, with the coated face preferably presented away from the article, one edge portion is folded under so as to bring the first portion of the coating beneath the uncoated face and in face-to-face relation with the second portion of the coating on the previous turn of wrapping material. Thus, the first and second portions of the adhesive coating are brought into contact where adjacent turns overlap, so as to form a strong bond.

The adhesive material used is preferably of the kind generally known as a "cold seal" adhesive. Conveniently the adhesive may be applied uniformly across the entire width of the first face of the wrapping material, so that the first and second portions of the coating are continguous and the degree of overlap between adjacent turns of the winding can be varied in different applications. However, in some cases the first and second portions of the adhesive coating may be spaced apart, for example confined to the opposite marginal regions of the first face. This may be particularly desirable where the wrapping material is relatively wide so as to avoid wastage of adhesive in the central region where adhesion is not likely to be required.

Typically the wrapping material may be in the form of a strip having a width of between about 5 cms and about 15 cms. The material may comprise a suitable grade of paper, reinforced if necessary, single or multiple-ply, creped or plain. Other materials such as plastic films, metal foils or non-woven web materials may also be used where appropriate.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
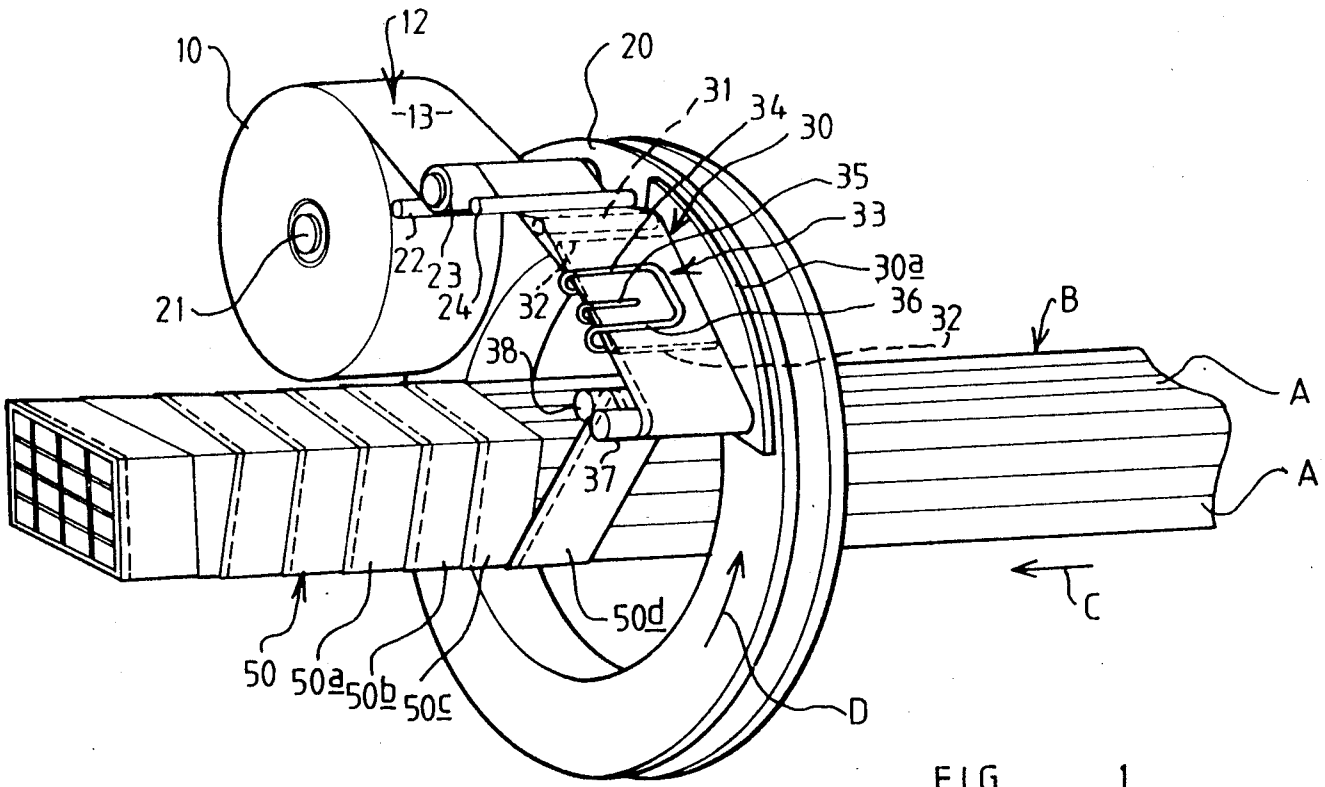
FIG. 1 shows apparatus for carrying out the method of the invention
Figure 2:
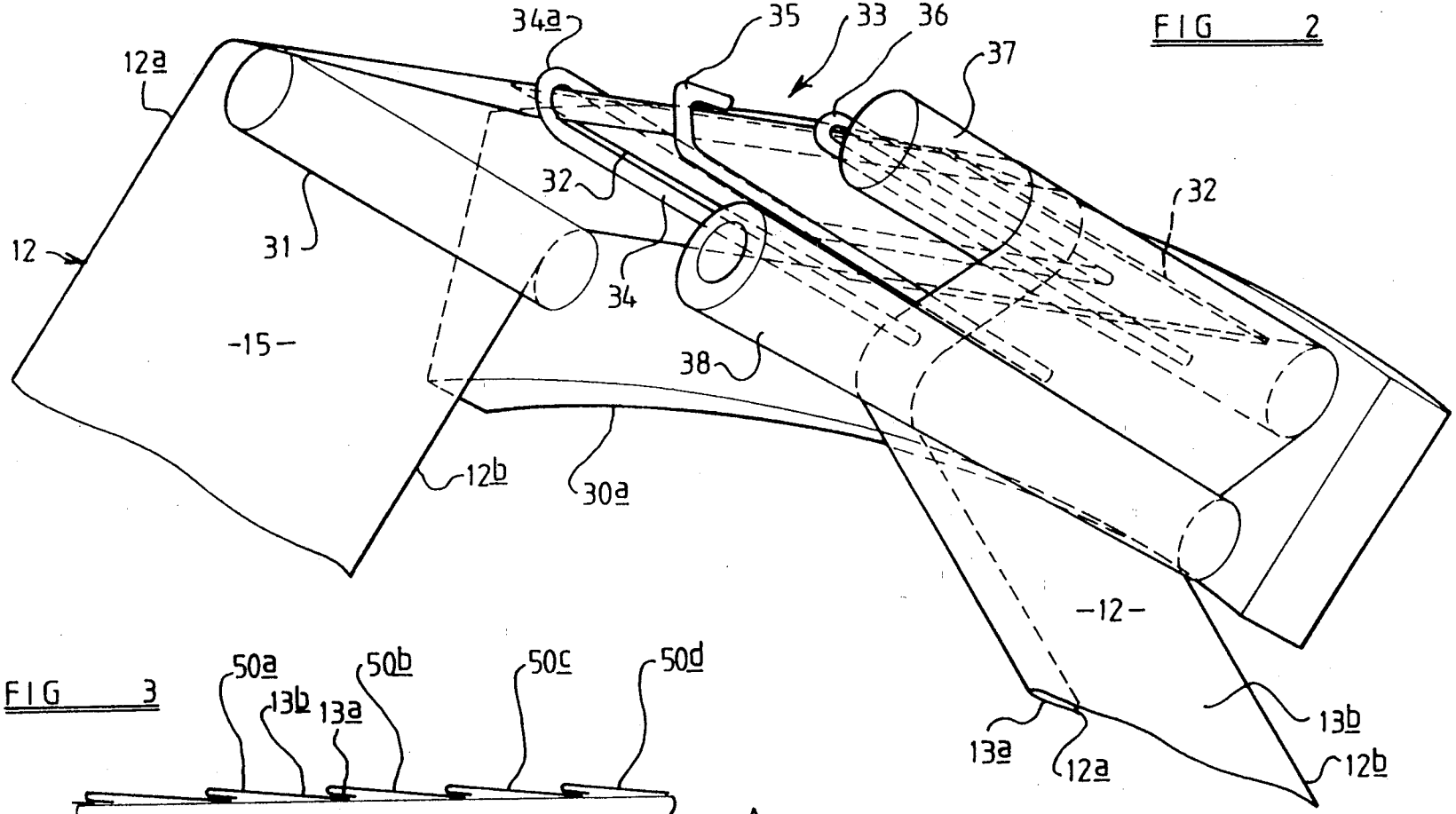
FIG. 2 shows in more detail a preferred arrangement for turning over a portion of the wrapping material.
Figure 3:
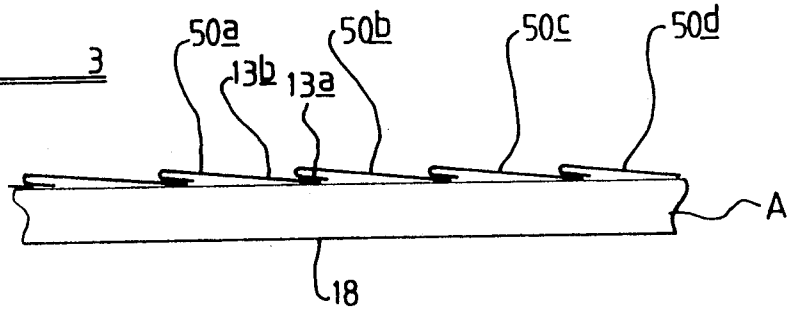
FIG. 3 is a schematic section through part of a wrapped article comprising a bundle of individual elements.

In a generally conventional manner elongate elements A are assembled into bundles B which are held together, for example by means of rollers (not shown) and advanced through a wrapping station in the direction indicated by arrow C, although some form of primary fastener such as self-adhesive tape, plastic or metal strapping may be necessary to hold together a bundle comprising of a substantial number of elongate elements with complex cross-sectional configurations. In the wrapping station, a roll 10 of wrapping material 12 is mounted on a roller holder 21 carried by an annular member 20 which surrounds the bundle B and rotates in the direction of arrow D as the bundle B advances through the wrapping station. Material 12 from the roll 10 is thus wrapped around the bundle B to form a helical winding 50 in which adjacent turns 50*a*, 50*b*, 50*c* etc. of the wrapping material overlap.

In accordance with the invention, the wrapping material comprises a strip with one face 13 (preferably the face which is presented away from articles A) having a coating of "cold seal" adhesive material, for example of the kind comprising a blend of natural and synthetic rubbers which has only a low tack with regard to other materials, but bonds securely with itself without the application of heat.

In the illustrated embodiment, the face 13 is coated over its entire width and the opposite face 15 is uncoated. However, for the purposes of the invention, the adhesive coating can be considered to be divided notionally into two portions, namely a first portion 13*a* adjacent to one edge 12*a* of the material and a second portion 13*b* remote from said edge 12*a*. Nevertheless, the coating need not necessarily extend across the entire width of the face 13, and the two portions need not be contiguous. Thus, the first portion may be disposed at or adjacent to the edge 12*a* of the material and the second portion may be disposed at or adjacent to the opposite edge 12*b*.

In the roll 10, the coated face 13 of the material is presented outwardly and as the material is dispensed from the roll it passes through a tension controlling arrangement comprising pins 22, 24 and a tension roller 23 carried by the annular member 20. Thereafter, the material passes through a folding device 30 comprising a mounting plate 30*a* carrying a first pin 31, a flat plate 32 and a guide assembly 33 including spaced U-shaped members 34, 36 and an intermediate J-shaped member 35, all embracing the flat plate 32 and in combination with the plate defining the path of the material 12 towards the bundle B. The first pin 31 has a length somewhat less than the width of the material 12 so as to allow the margin adjacent to edge 12*a* to fold over the end of the pin. The members 34, 35 and 36 extend from the plate 30*a* and each is successively shorter. The rounded end portion 34*a* of the first member 34 ensures that the margin of the material is turned downwardly and then inwardly, and the succeeding members 35, 36 complete the folding of the material so as to bring the first portion 13*a* of the coated face 13 beneath the plate 32 so that as the material leaves the folding device the first portion 13*a* of the coated face is disposed beneath the second or remaining portion 13*b*. The folded material then passes around two further tensioning pins 37, 38 before being applied to the bundle B.

Thus, the inturned marginal portion 13*a* of the coated face of each turn (such as 50*d*) of wrapping as it is laid down is presented towards the remaining portion 13*b* of the coated face of the previous turn (such as 50*c*) of wrapping material on the bundle B, thereby causing adjacent turns to adhere firmly to one another under the tension applied by the wrapping process.

Because of the nature of the adhesive material employed, the wrapping machine does not require any special maintenance and there is no release paper or the like to be discarded. The adjacent turns of the wrapping are securely adhered together so as to prevent the ingress of dirt or moisture. The turned over edge of the wrapping material is more resistant to mechanical damage than the exposed edge of unfolded wrapping materials as previously employed, and when the bundle is to be unwrapped the wrapping can simply be slit along the length of the bundle and be removed in a single piece or a few pieces instead of falling into many fragments as is the case when conventional wrappings are employed.

Preferably, the adhesive material is applied across the full width of the wrapping material, and is applied to the bundle B with the uncoated face in contact with the articles A. However, other arrangements are possible. In particular, where convenient two or more separate strips may be applied simultaneously from respective rolls carried at spaced positions around the annular member 30. The adhesive coated face may alternatively be presented towards the bundle B, with the marginal portion turned outwardly instead of inwardly. Also, in some cases the adhesive material may be applied only to the lateral marginal portions of the wrapping material, instead of across the full width. The coated portions need not extend fully to the edges of the material. Thus, with wrapping material having a width of for example approximately 15 to 20 cms, the adhesive material may be confined to areas approximately 5 cms wide along each edge, allowing for an overlap of up to 5 cms on adjacent turns. However, where the wrapping material is somewhat narrower, typically between about 5 cms and about 10 cms, it is convenient to coat the full width of the material as this enables the width of the turned over margin and the width of the overlap to be varied to suit different applications, without requiring wrapping material specific for such applications.

In order to ensure that adjacent turns of the wrapping material are adequately secured to one another, the wrapping machine many include rollers (not shown) downstream of the wrapping station to engage the exterior surface of the bundle and press the turns of wrapping material together.

It is also particularly advantageous to make use of wrapping material in the form of crepe paper, applied in such a manner that the paper is somewhat stretched as it is applied to the bundle B, the tension in the paper also serving to hold successive turns together. Additionally, the inherent elasticity of crepe paper enables the wrapping to stretch as necessary if the bundle B bends during subsequent handling and transportation.

Whilst in the accompanying drawings the bundle B is shown to be composed of several straight articles A, it will be appreciated that the articles may be of curved or other non-linear form and the bundle may be of either constant or varying cross-sectional dimensions throughout its length, subject only to the ability of the bundle to pass through the annular member 20. The bundle may also be in the form of a loop, for example a coil of wire, but in such a case the annular member will in known manner be formed as two separable components which can be parted to allow insertion and removal of the bundle.

Of course, as previously mentioned, the method may also be applied to single articles as well as to bundles of articles.

We claim:

1. A method of wrapping an elongate article by forming a winding of at least one strip of flexible wrapping material helically around said article so that successive turns of the wrapping overlap one another, characterized by the use of a strip of wrapping material wherein a first face of the strip carries first and second portions of a coating of an adhesive substance of a per se known kind which without the application of heat adheres strongly only to itself and wherein a second face of the strip is free from said adhesive material, and by the steps of turning over a longitudinal edge portion of said strip which includes said first portion of the coating so as to fold the second face of the strip onto itself, and laying the folded strip onto the article with the second portion of the coating on each turn of the winding in contact with the first portion of said coating on an adjacent turn of the winding while said second portion of said coating on said first face of the strip is directed away from the article being wrapped and said longitudinal edge portion is turned inwardly, said first portion of the coating facing towards the article being wrapped.

2. A method according to claim 1 wherein said first and second portions of the adhesive coating are contiguous.

3. A method according to claim 2 wherein said adhesive coating extends across substantially the entire width of said first face.

4. A method according to claim 1 wherein said first and second portions of the adhesive coating are spaced apart across the width of said strip.

5. A method according to claim 1 wherein said adhesive substance is substantially nonadherent to said second face of said strip.

6. A method according to claim 5 wherein said adhesive substance is substantially nonadherent to the article being wrapped.

7. A method according to claim 1 wherein said adhesive substance is substantially nonadherent to the article being wrapped.

8. A method of wrapping an elongate article by forming a winding of at least one strip of flexible wrapping material helically around said article so that successive turns of the wrapping overlap one another, characterized by the use of a strip of wrapping material wherein a first face of the strip carries first and second portions of a coating of an adhesive substance of a per se known kind which without the application of heat adheres strongly only to itself and wherein a second face of the strip is free from said adhesive material, and wherein said adhesive substance is substantially non-adherent to said second face of said strip and substantially non-adherent to the article being wrapped, and by the steps of turning over a longitudinal edge portion of said strip which includes said first portion of the coating so as to fold the second face of the strip onto itself, and laying the folded strip onto the article with the second portion of said coating on each turn of the winding in contact with the first portion of said coating on an adjacent turn of the winding.

9. A method of wrapping an elongate article by forming a winding of at least one strip of flexible wrapping material helically around said article so that successive turns of the wrapping overlap one another, characterized by the use of a strip of wrapping material wherein a first face of the strip carries first and second portions of a coating of an adhesive substance of a per se known kind which without the application of heat adheres strongly only to itself and wherein a second face of the strip is free from said adhesive material, and wherein said adhesive substance is substantially non-adherent to the article being wrapped, and by the steps of turning over a longitudinal edge portion of said strip which includes said first portion of the coating so as to fold the second face of the strip onto itself, and laying the folded strip onto the article with the second portion of the coating on each turn of the winding in contact with the first portion of said coating on an adjacent turn of the winding.

* * * * *